United States Patent [19]

Steen

[11] Patent Number: 4,779,379

[45] Date of Patent: Oct. 25, 1988

[54] GATE OPERATOR

[75] Inventor: Clayton R. Steen, Idaho Falls, Id.

[73] Assignee: The Gatemaster Corporation, Carson City, Nev.

[21] Appl. No.: 12,371

[22] Filed: Feb. 9, 1987

[51] Int. Cl.[4] ..... E05D 7/00

[52] U.S. Cl. ..... 49/385; 49/339; 49/396

[58] Field of Search ..... 49/385, 340, 339, 346, 49/386, 396

[56] References Cited

U.S. PATENT DOCUMENTS

| | | | |
|---|---|---|---|
| 1,983,152 | 12/1934 | Stewart | 49/346 |
| 3,370,381 | 2/1968 | Wetter | 49/346 |
| 4,470,221 | 9/1984 | Courtis | 49/385 |
| 4,481,737 | 11/1984 | Rebhan et al. | 49/385 |

*Primary Examiner*—Kenneth J. Dorner
*Assistant Examiner*—Gerald A. Anderson
*Attorney, Agent, or Firm*—Herzig & Yanny

[57] ABSTRACT

A gate operator for lifting a gate about a horizontal pivot at a lower proximate corner thereof about a 90° arc in the plane of the gate and having spring means for balancing and holding the gate weightless in all positions of its arcuate movement, permitting the gate to be moved between fully opened and closed positions manually or with minimum applied force, and preferrably comprising crank-like means operating through a raceway on the face of a driving wheel, the gate operator having a position locking the gate in its closed position against vertical forces exerted at the gate for opening same; and a safety snubber controlling the speed of the gate in either opening or closing movement.

8 Claims, 6 Drawing Sheets

FIG. 1.
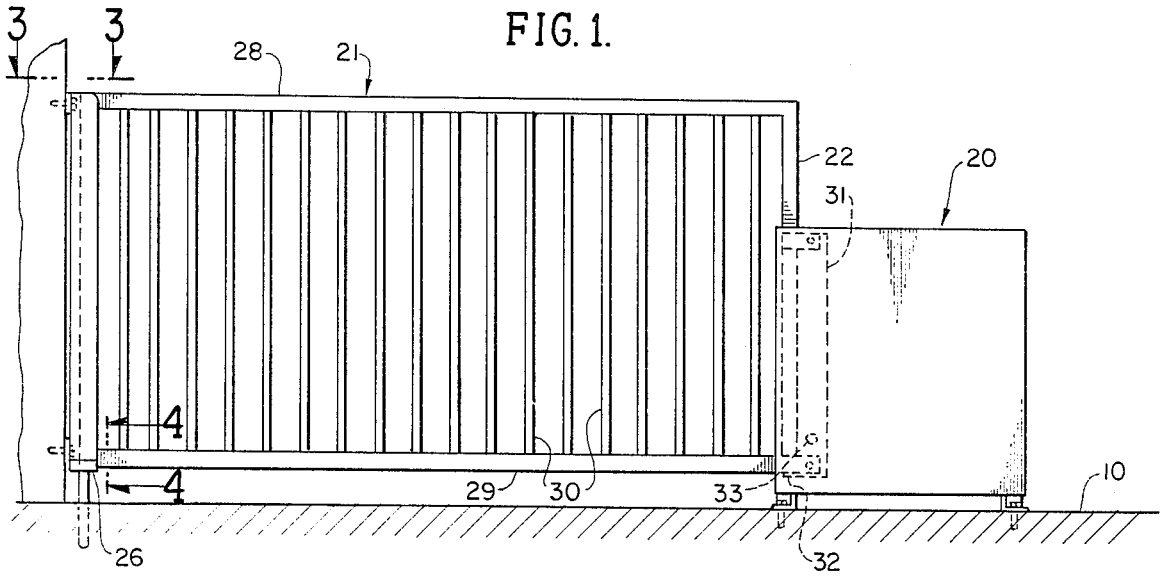
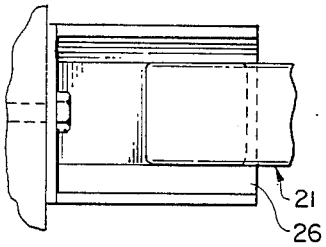
FIG. 3.
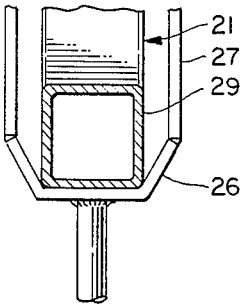
FIG. 4.
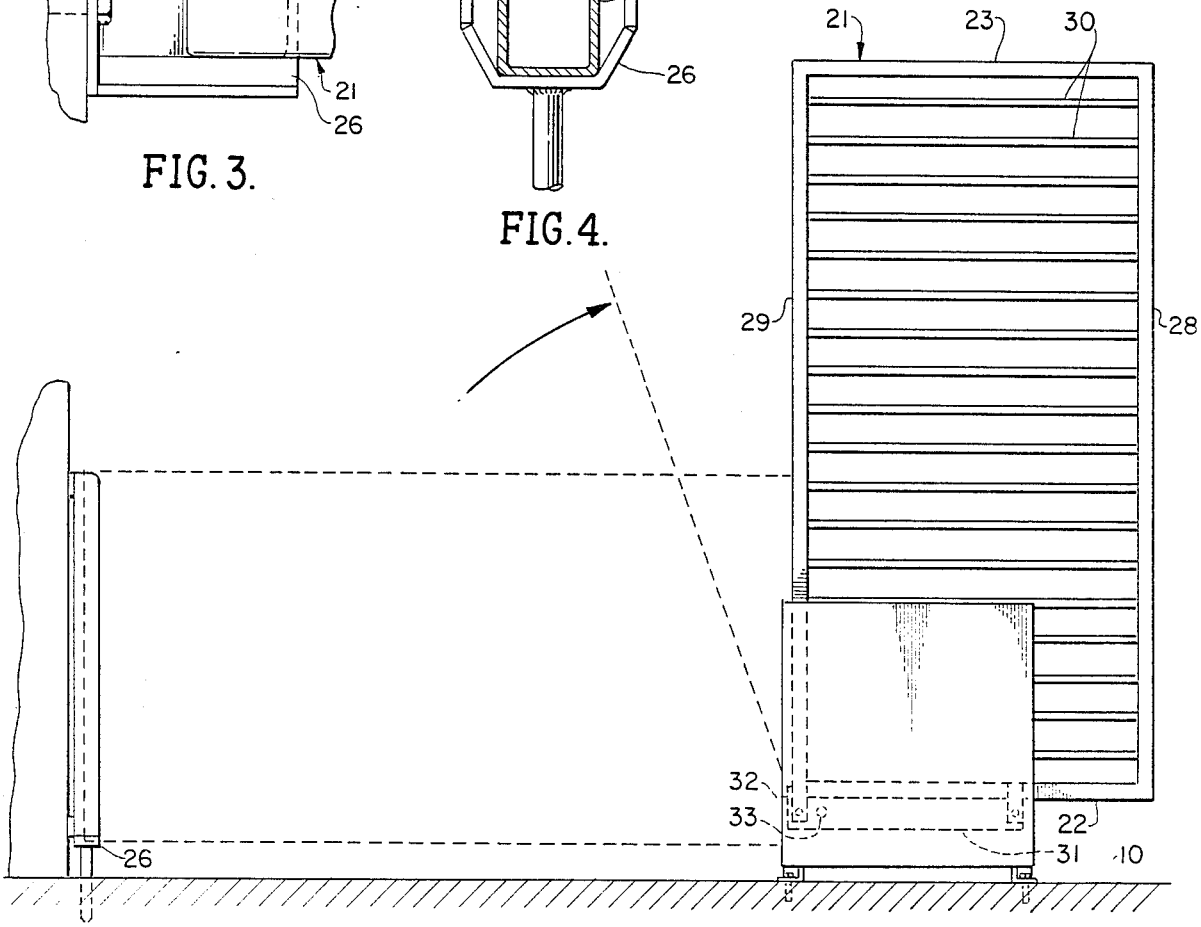
FIG. 2.

FIG. 10.
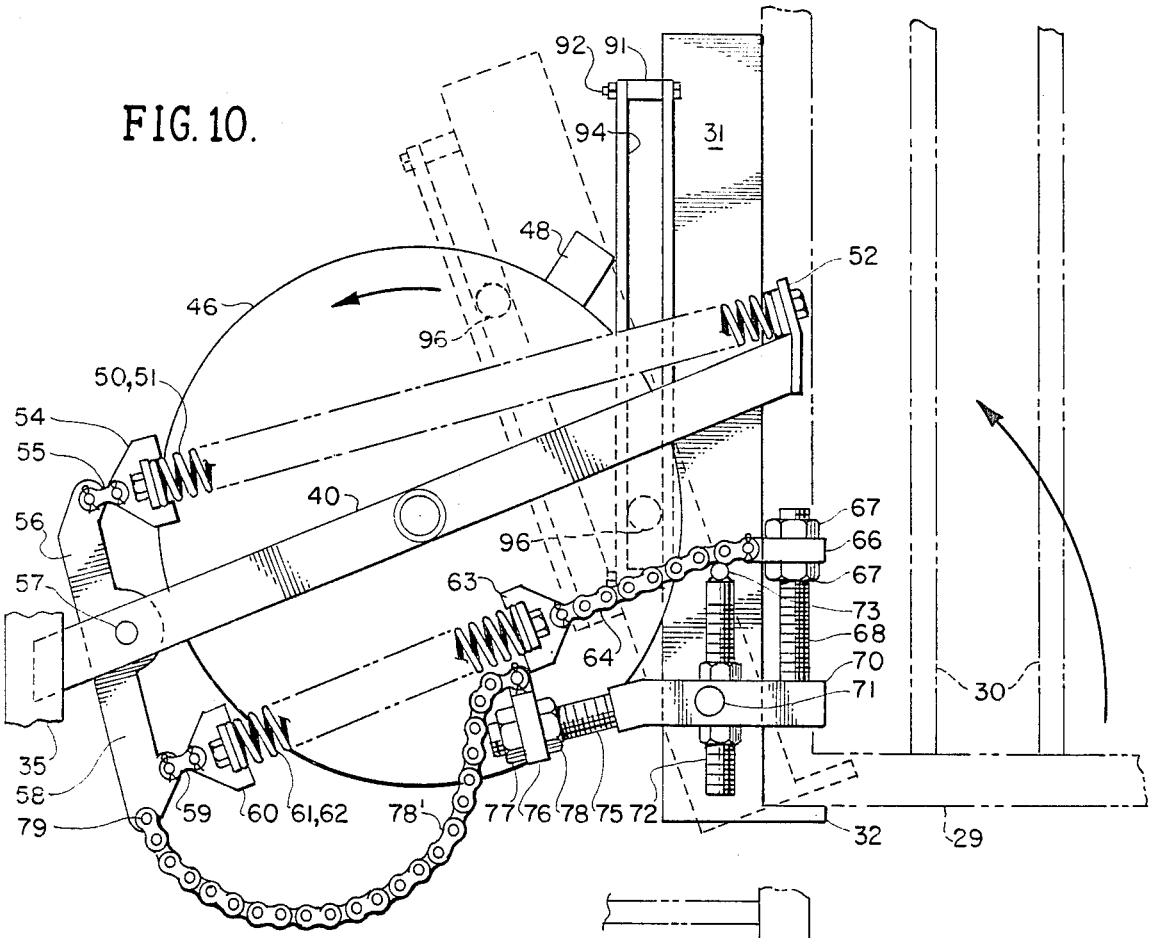
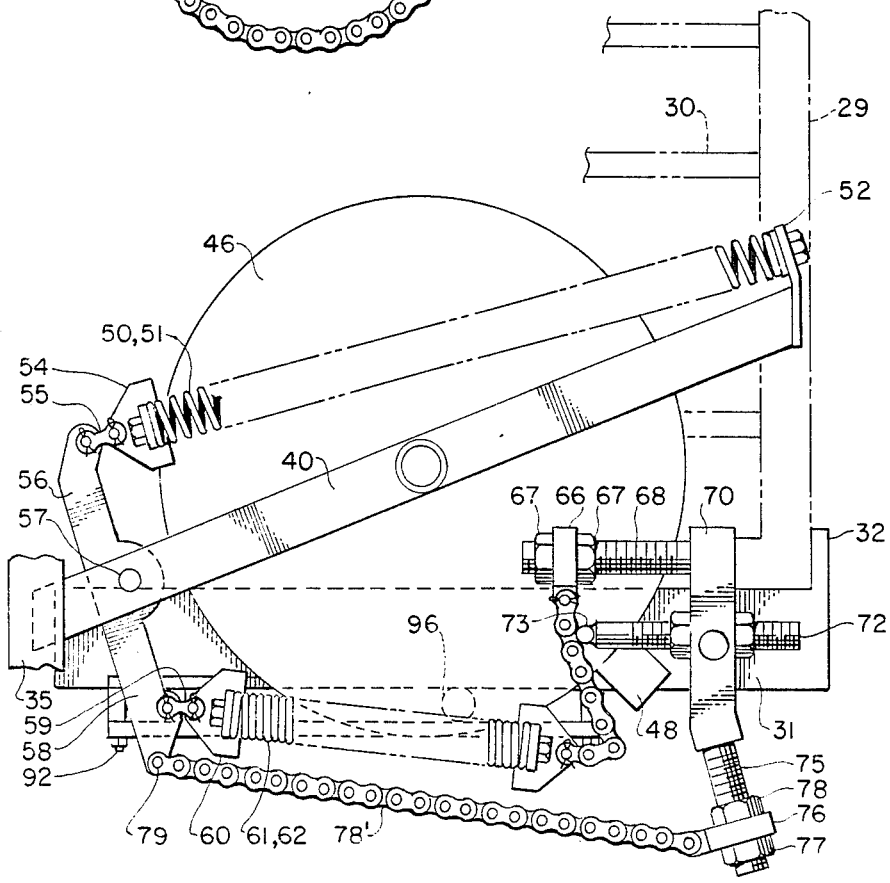
FIG. 11.

GATE OPERATOR

BACKGROUND OF THE INVENTION

1. Field of the Invention

This invention relates, in general, to vertically tilted gates and, more particularly, to a gate tiltable under adjustable spring tension to an upright open-gate position or to a downwardly lowered closed-gate position on a 90° arc of rotation about a horizontal axis and operatively held in effective weightless adjustment at all such angles. Optionally, the gate, regardless of its weight is capable of operating in remote locations on a fractional horsepower battery safely, economically and with facility. A preferred cam and raceway operation system is capable of positioning the gate by such motor or manually, at a controlled speed in both directions, by a unique hydraulic bleeder and snubber safety device in this combination and as utilized. The invention will accommodate a gate of any height because the gate operator is constructed and arranged with open ends, permitting the gate to pass through or extend beyond the sides thereof.

2. Brief Description of the Prior Art

The closest prior art known to the Applicant is the spring-operated Model JBID-2 Vertical Lift Gate manufactured by Triangle Bar Manufacturing division of Silver Falls Corporation. Said prior art includes a gate operator attached to a vertical lift gate. The gate is not, however, mounted to achieve weightlessness and has no means for spring adjustment to accomplish such purpose for gates of any weight or configuration nor of a height greater than the width of the gate operator. The attendant advantages of the instant invention are not present in the prior art intended to accomplish the pivoted gate lifting operation.

Said prior art utilizes a full wheel connected to a control arm pivoted to the gate to control the lowering and raising thereof and separate locks, but these do not achieve the control and beneficial operation of Applicant's speed-controlled safety structure, including his raceway and bearing traveling therein, nor to the unique arrangement of the parts whereby the gate is secure in both horizontal and vertical positions and stabilized in positions thereinbetween.

OBJECTS AND SUMMARY OF THE INVENTION

The present invention has as a major object the provision of a vertical lift-gate operation capable of being mounted on and used in virtually any terrain.

Another object is to provide a vertical rise gate operator so constructed and arranged as to counterbalance and neutralize the weight of a gate of substantial mass in a manner to move it manually or by minimum force and with facility to any position from horizontal (closed) to vertical (open).

A further object of the invention is to provide a unique combination of springs and associated means for applying varying degrees of tension as through a cam and raceway or the like, contingent upon the attitude and degree of elevation of the gate, and with varied speeds for optimum effectiveness.

Yet another object of the invention is to provide a gate of the character described whose weight is counter-balanced and supported regardless of its height, length and mass in seeming weightlessness in any position of operation with an expenditure of minimum power to position the same.

A further object of the invention is the provision of effective and efficient yet simple and economic methods and means for timing and programing the gate's operating mechanism, including preferred safety means.

It is another further object of the invention to provide new and improved adjustable means for accomplishing the objects among others herein stated.

Another object is to provide in combination with the means and methods herein described, effective safeguards for its controlled safe use and operation.

In summary, a gate-supporting structure is provided, constructed and arranged to swing a gate in a vertical plane from a closed position to an open position through a 90° arc of rotation on a horizontal pivot. And to accomplish such purpose, an arrangement of springs are adjustable through appropriate linkages to hold a massive gate in a state of seeming weightlessness throughout its arc of rotation. The operative spring mechanism is stressed in extreme open and closed positions, and preferably unstressed in a predetermined arcuate open position, as for example, where the gate's center of mass is approximately 70° from the horizontal and above the fulcrum. Effective means, preferably a cam and raceway, is arranged for increasing mechanical advantage and decreased speed of movement as the extremes of open and closed gate positions are approached, and for accelerated movement therebetween.

The drive means is associated with a slipping clutch for facile, smooth and simple gate operation. A fractional horsepower motor powered by a storage battery or the like provides the necessary force to control the lifting and lowering of the gate.

With the above and other objects in view, this invention resides in the novel features of form, construction, mode of operation and combination of parts presently described and as comprehended by the claims.

BRIEF DESCRIPTION OF THE DRAWINGS

Having thus described the invention in general terms, reference will now be made in the accompanying drawings in which:

FIG. 1 is a front view of a gate-operator and gate in horizontal closed position constructed and arranged in accordance with the present invention.

FIG. 2 is a view similar to FIG. 1, but with the gate in open position.

FIG. 3 is a partial sectional view on a line 3—3 of FIG. 1.

FIG. 4 is a sectional view along a line 4—4 of FIG. 1.

Figure 5:
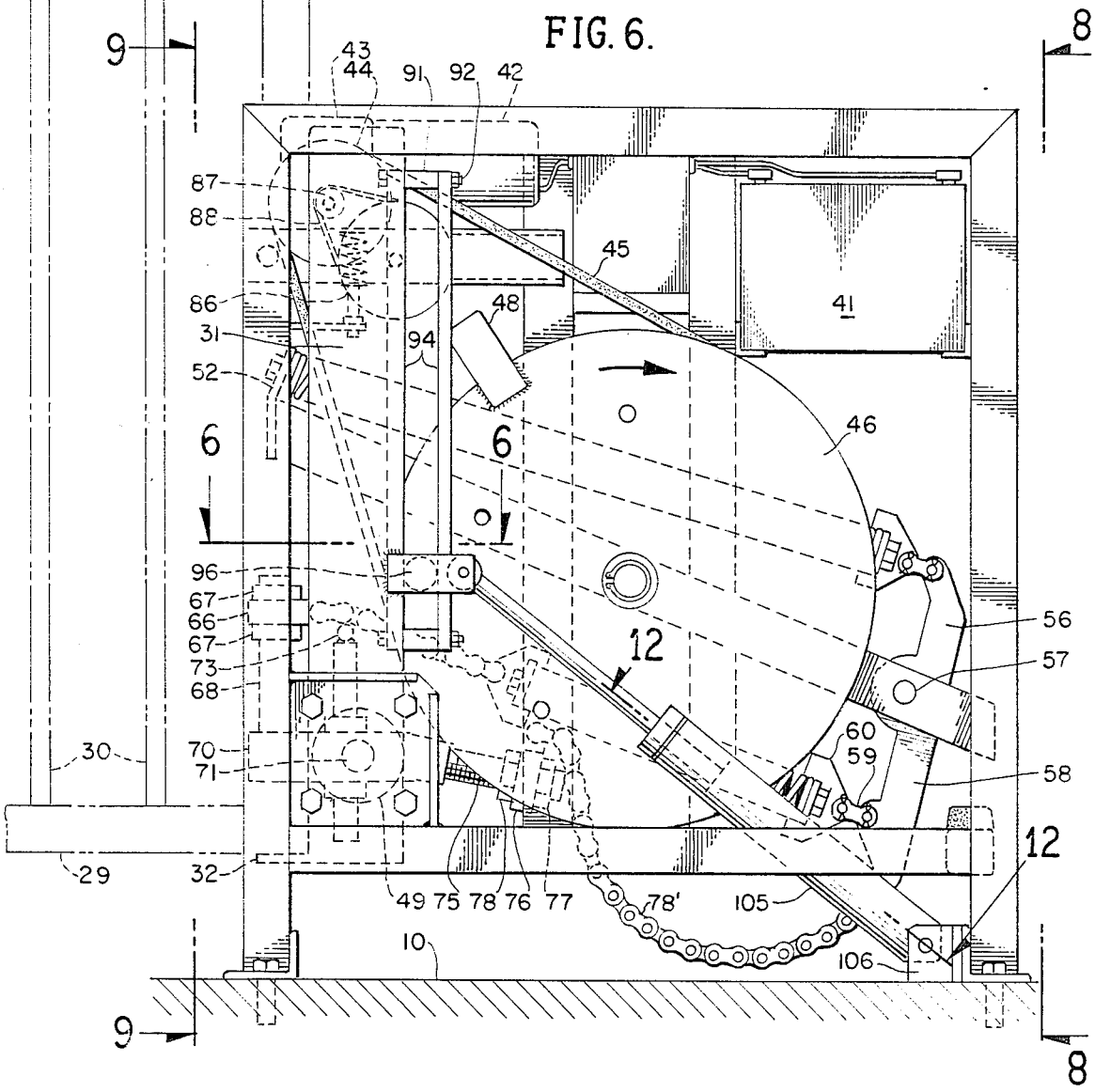

FIG. 5 is a more detailed view of the operator of FIG. 1.

Figure 6:
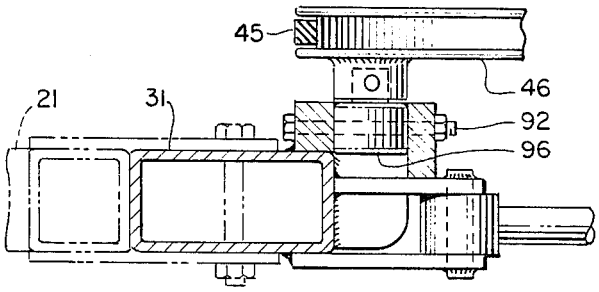

FIG. 6 is an enlarged sectional view along a line 6—6 of FIG. 5.

Figure 7:
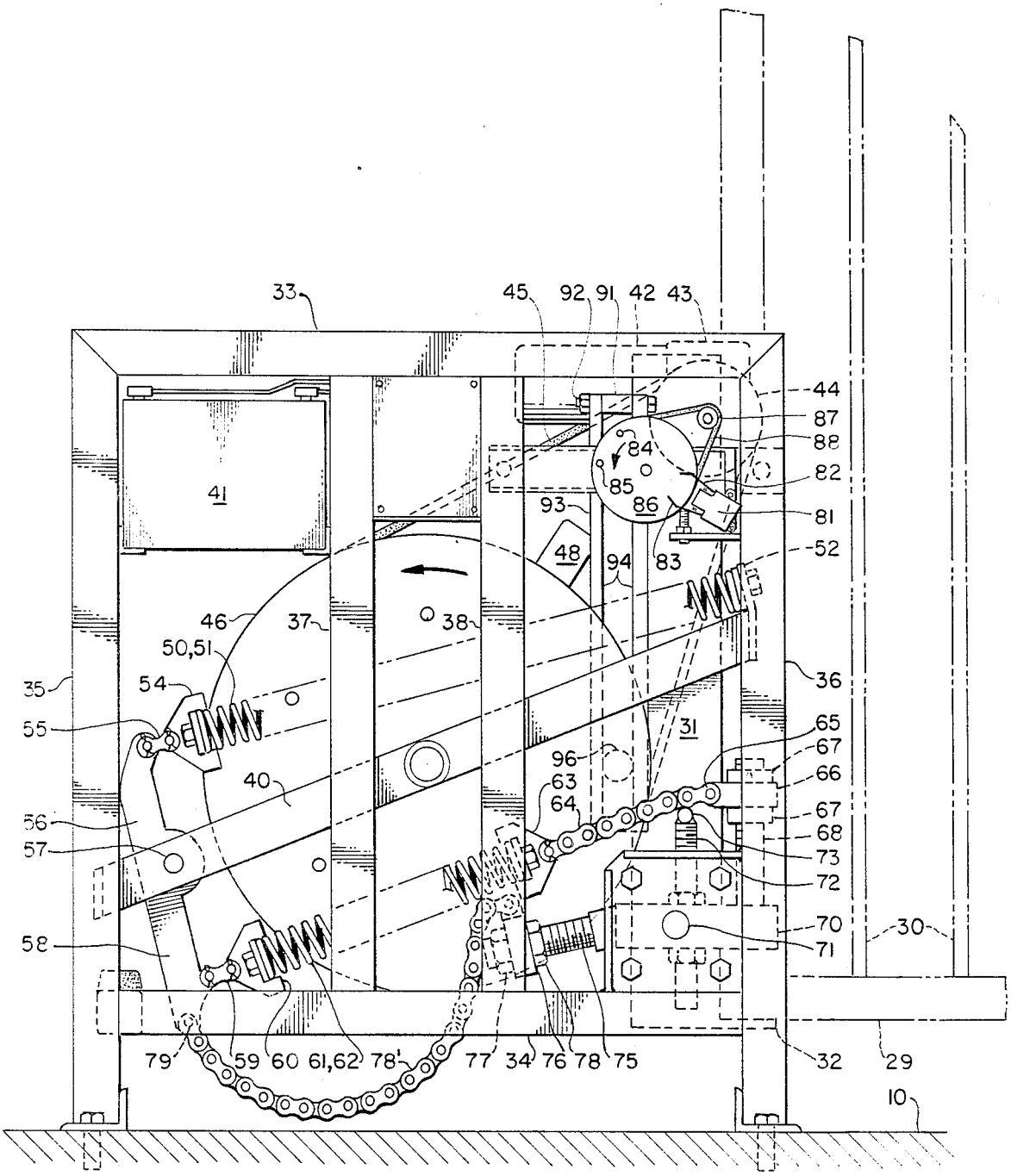

FIG. 7 is a rear view of the gate operator and associated gate shown in FIG. 5.

Figure 8:
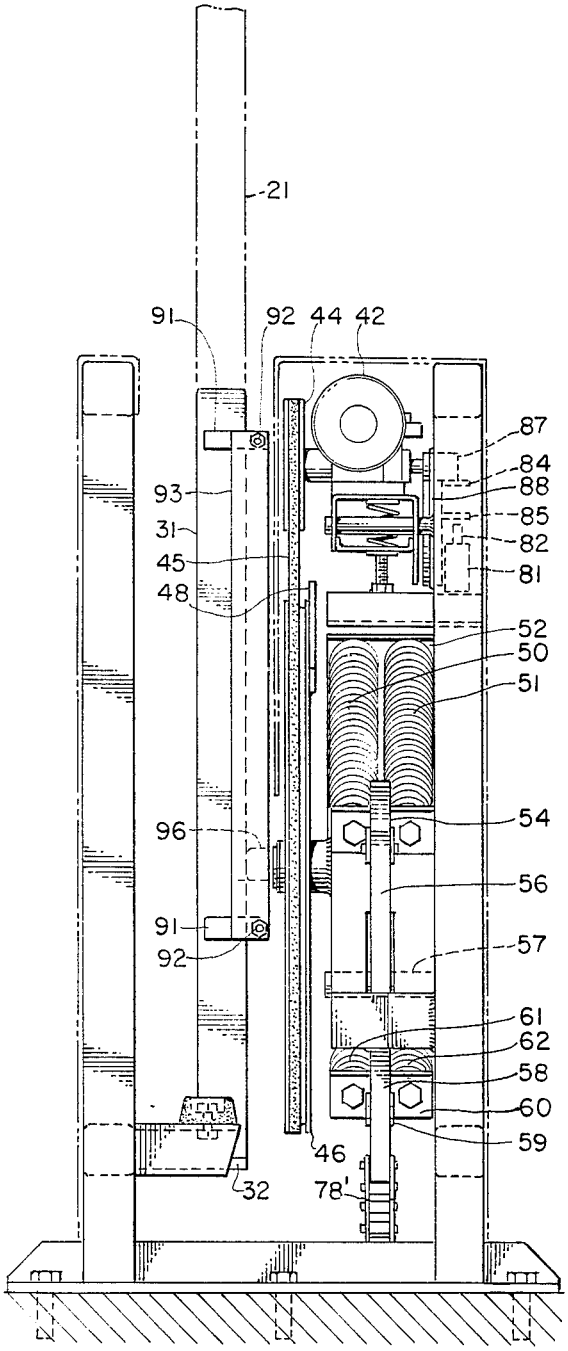

FIG. 8 is a view of the gate operator viewed on a line 8—8 of FIG. 5.

Figure 9:
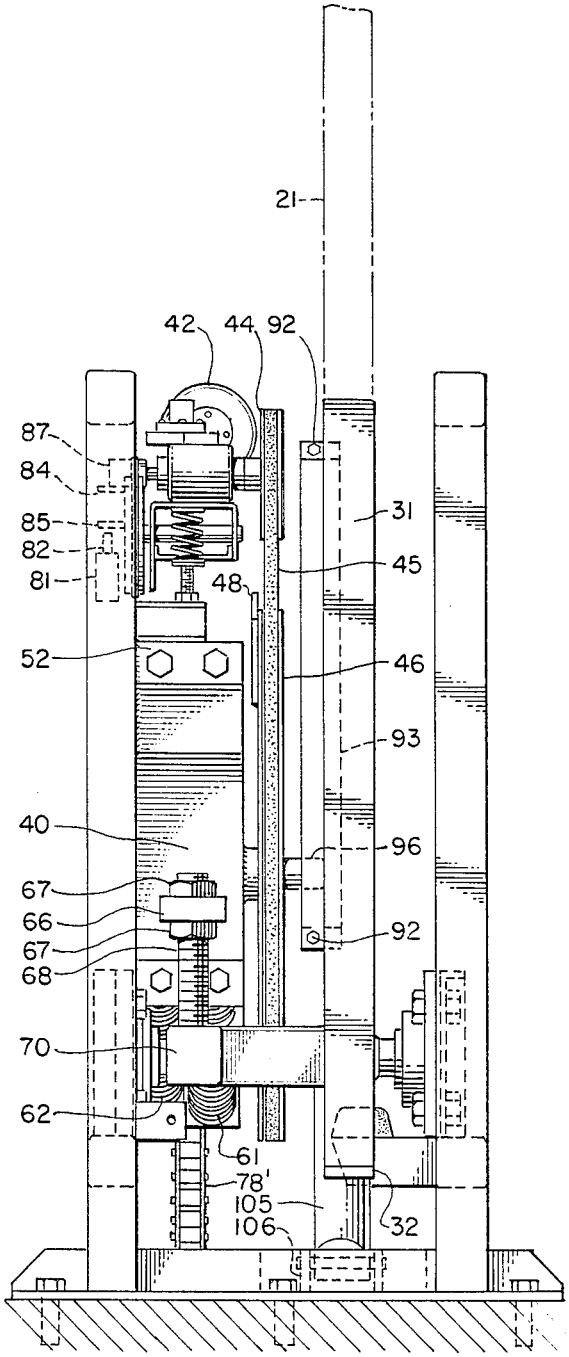

FIG. 9 is a view of the gate operator on a line 9—9 of FIG. 5.

FIG. 10 is a view like FIG. 9 with selected operative parts inserted for better clarity in other operative relationships.

FIG. 11 is a view like FIG. 9, but with the gate in the open position.

Figure 12:
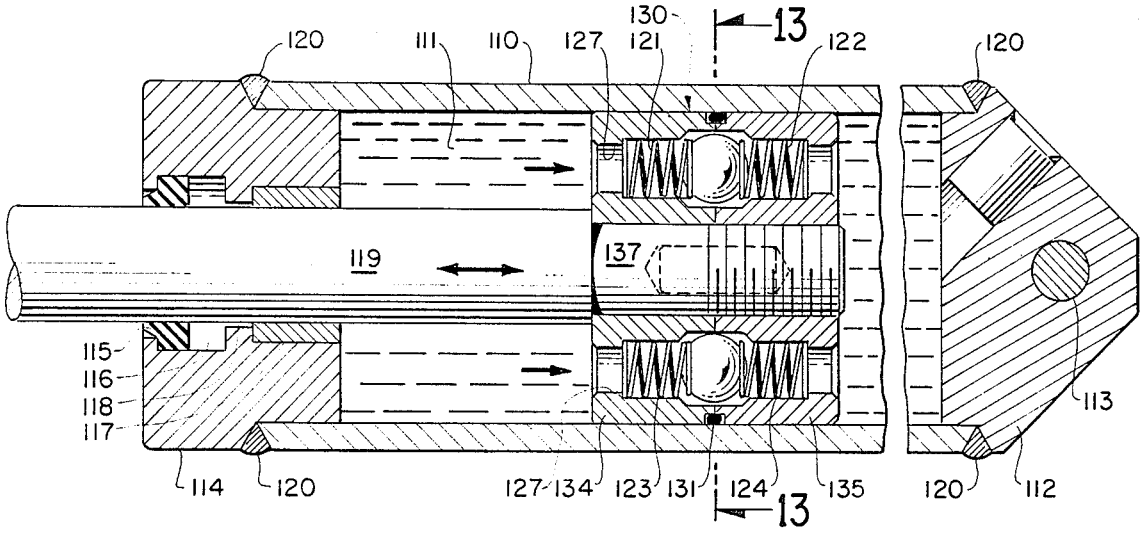

FIG. 12 is a sectional view of a preferred form of a speed regulator and snubber for the gate operator.

Figure 13:
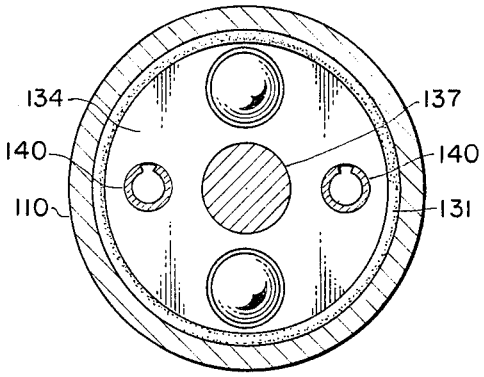

FIG. 13 is a sectional view on a line 7—7 of FIG. 10.

DETAILED DESCRIPTION OF PREFERRED EMBODIMENT

Referring now more in detail and by reference characters to the drawings which illustrate a preferred embodiment of the present invention, and more particularly, FIGS. 1,2,3, and 4, reference numeral 20 designates a gate operator (opener and closer) connected to a gate 21 having an inner vertical frame member 22 secured to the gate operator and an outer frame member 23 vertically disposed on a cradle 26 and held in a vertical channel 27 above the cradle. The gate can be of any height, shape, material, or construction and may include a top rail 28, a bottom rail 29, and any number of bars 30, or the like, or it may be solid. The gate operator includes a gate supporting frame member 32 pivoted at 33 and to which the gate is affixed securedly and preferably permanently. Welding may be used as illustrated. A toe 32 thereon can provide added support while facilitating assembly. Reinforcement plates or the like may be used, bolted or welded to the gate and to the gate post 31.

The gate operator thus includes a rigid frame strongly constructed, and can include upper and lower members 33 and 34, side members 35 and 36, and any desired number of vertical members 37 and 38 therebetween. An angularly disposed frame member 40 is welded to the frames 34, 36, 37 and 38.

Mounted on the frame are an electric battery 41 as a source of power for an electric motor 42 drivingly connected to a drive pulley 44, which drives a belt 45, and thereby a large pulley wheel 46 grooved to receive the flexible drive belt 45 with an adjustable driving tension device spring 47 loaded and pivoted. Wheel 46 carries an integral stop finger 48 welded thereto. When the wheel 46 has rotated sufficiently in a clockwise direction, as illustrated in FIG. 5, said stop 48 engages a portion of the frame at 49. The rotation of the wheel is stopped and the belt 45, if it continues to be driven by the wheel 44, slips and thereby provides a clutching action for a predetermined amount of time and distance adequate to allow movement of the gate from a fully lowered position to a fully raised position, or vice-versa.

A spring means can comprise a pair of coil springs 50, 51 fixed at one of their ends 52 to the frame 23, and attached at their other ends in a clamp device 54 secured through flexible linkage 55 to a rocker arm 56, pivoted at 57 on the frame member 40, and at their other end 58 connected through a link 59 and clamp 60 to another pair of springs 61, 62. The latter springs are, in turn, connected at their other ends through a similar clamp device 63 to a link chain 64, whose other end 65 is connected to a block 66 and confined by nuts 67 on the end of a threaded shaft 68 on a block 70 pivotally mounted on a horizontal pivot pin 71, and also supporting a bolt 72 threaded through the block 70 and carrying a cam 73 thereby adjustably positioned under or against the link chain 64 to adjust the tension of the chain as needed. The block 70 also carries a threaded post 75 preferably extending through a block 76 on which it is secured by jam nuts 77 and 78. Pivotally connected to the block 76 is a link chain 78', which in turn is pivotally connected to the rocker arm 56 at 79.

In a first preferred embodiment a microswitch 81, has blades 82 and 83 engageable with selected pins 84 and 85 mounted in and rotatable with a belt-driven wheel 86 connected to the wheel 46 through a wheel 87 by a belt 88.

The gate post includes and carries a raceway 94 defined by spacer blocks 91 attached thereto by bolts 92 for supporting a plate 93. In the raceway 94 thus defined, a roller bearing cam 96 is moveable. The cam is journaled on the inner face of the large pulley wheel 46 and moves along the raceway 94 in response to the rotation of the wheel for raising and lowering of the gate.

In a second preferred embodiment, the microswitch causes the motor 42, when engaged, to operate for approximately 8 seconds—depending upon the rate of rotation of the wheel 86 or its like—and then interrupts the flow of power to the motor until energized, after which time the motor will operate in opposite rotation. The addition of the timer replaces the two microswitches that serve as limit switches stopping the motor at the limit of horizontal or vertical movement of the gate. In conjunction with the clutch effect of further movement of the large bull wheel 46, after the eight-second interval would be self-adjusting if the time interval that the motor operates the forced shutoff of the timer somewhat exceeds the time in which full travel of the gate from full open (FIG. 2) to full closed (FIG. 1) position occurs. The resulting slight belt clutching action allows for variation in wear temperature and other forces in eliminating the need for critical adjustments. The clutch effect also assures that the bearing on the bull wheel moving in the cam raceway will be fully positioned in the horizonal attitude of the gate and provide a locking action against raising of the gate by any lifting force or attempt at the gate. Such locking action occurs when the full wheel has moved in a counter-clockwise rotation as illustrated, for example, in FIGS. 7 or 10 beyond the dead center (six o'clock) position. In the counter-clockwise rotation of that wheel the roller bearing 96 is thus at an approximate five o'clock position and its raceway has assumed such an angle in the lower position of the gate as to resist and prevent any upward movement of the gate by lifting efforts made at the gate itself as shown most clearly in said FIGS. 7 and 10.

To preclude too rapid movement of the gate in any direction, a snubber action is provided by a check valve arrangement. As illustrated in FIG. 5, a snubber 105 is secured at one end of the bracket 106 welded to the frame of the gate operator and on the gate post 31.

Having reference to FIGS. 12 and 13, a housing 110 defines a cylindrical chamber in which a fluid 111 is hermetically sealed at one end by plug 112 having a journaled connection at 113 with the frame, and at its other end by plug 114 making fluid seals 115, 116, 117 and 118 between the plug 114 and a pistion shaft 119 and the interior of the cylinder. Both members 112 and 114 are welded closed at 120 against any accidental opening or tampering.

Also permanently mounted and secured within the chamber is a two way check valve spring urged to a central position as by coil springs 121, 122, 123 and 124, thereby retaining the balls normally axially centered at 127, but readily seatable when sudden or excessive flow in any direction occurs in the respective ball-occupied bores or passages, thus snubbing and checking the movement of the parts herein described to prevent movement of the gate except at a predetermined metered rate.

The pistons 130 are also provided with a rubber O-ring seal or the like 131 between the symmetrial halves 134, 135, 136 comprising the piston secured on the threaded end 137 of the shaft 119. Relative rotation between the segments 133 through 136 is prevented also by a pair of retainer sleeve-pins 140 press-fitted into corresponding bores to prevent such relative rotation. The fluid, preferably oil, thus flows freely without restriction if the gate moves from its upper to the lower position, or vice versa in approximately 5 to 8 seconds, as stated. Should the gate be freed of other motion restricton, this piston motion would limit the speed of decent of the gate in that the orifice size and the spring positioning of the balls would dictate the flow rate and consequently the speed with which the piston can move.

There has been illustrated and described a unique and novel highly effective gate operator and method with systems capable of precluding unauthorized operation, and which also permits complete metered and efficient gate movement with improved safety. Thus, the invention fulfills all of the objects and advantages which have been sought.

IN USE

The principle of the vertical rise gate operator is to counter-balance or neutralize the weight of the gate in any position from horizontal to vertical. This is accomplished by springs 50–51 and 60–62 that apply varying degrees of tension through the cam 96 and raceway system 94 contingent upon the attitude or degree of elevation of the gate 21 which thereby can be operated with a fractional horsepower motor. The motor and its drive mechanism serve only to position the gate rather than exert prime force necessary to lift the mass of the gate itself.

The operator 20 is readily attached to a concrete slab 10. Being a self contained unit, it becomes operable by a variety of control devices such as a remote transmitter, digital panels, or suitable standard switching devices.

The vertical counterbalance is attached most readily to the gate's open adjustment shaft 75 when the gate is fully closed. To bring the gate to total upright position manually, it can be raised by use of a suitable come-along, securing one end of come-along as to the upper center portion of the gate, and an opposite end to the frame of the gate operator. Thereby, the center of gravity of the gate moves over the pivot pin 71 at an approximate 70° degree position from horizontal and continues by hand to full upright position with ease. With the gate in upright position, it is possible to attach the horizontal counterbalance chain 64 to the horizontal counterbalance shaft 68. Two jam nuts are preferably used on the shaft 68 and 75.

"Fine tuning" of the spring-balance mechanism commences with a horizontal balance of the closing gate with block 66 to threaded position at its upper end (FIG. 7). The assembly 66, 67 is moved down in approximately ½" increments until the gate remains stationary in any position from horizontal to 70° towards the vertical.

To achieve and complete open gate balanced position, the vertical spring block 76 is attached to adjustment shaft 75 with block at the end of the adjustment shaft 75. Then the block is moved inwardly (FIG. 7) on adjustment of the shaft 75 in increments until the gate moves freely and weightlessly from vertical to the 70° "dead center" position, after which the springs take over for balancing the remainder of gate's travel to horizontal position.

The gate should, as noted, remain stationary at any point in its 90° travel when movement is stopped. With adjustments properly made, the gate will be virtually weightless from horizontal to vertical.

The adjustment shaft with the adjustment spring block and chain, functions only from horizontal to approximately 70° where the gate is balanced over the bearing. From this point to total upright position (90°), the adjustment shaft and adjustment spring block come into play to ease the gate smoothly into complete upright position. The positioning bearing is employed to return the gate to horizontal position. Cam posts 70, 73 can be adjusted and/or repositioned to assure smooth operation throughout full cycle of the gate. Thus, for much heavier gates the cam can be relocated in its block 70 in a similar manner, but left of its position now shown in FIG. 7.

Moving the adjustment spring block out from base towards the end of the adjustment shaft tends to reduce the weight of the gate. If the gate is too light and has a tendency to rise too easily, moving the adjustment spring block in the opposite direction will correct the imbalance. If adjustment results in the spring block being within approximately 1" from the end of the adjustment shaft, ½ link from the chain can be removed for readjustment.

Adjustment balance (see FIG. 7) is accomplished more readily if the gate is in vertical position, for then tension is relieved from the adjustment shaft. The cam post is adjustable to form an arc from the adjustment block to its spring for assuring counterbalance at all points between 0° to 70°.

It should be understood that many changes, modifications, variations and other uses and applications of the gate operator and systems will become apparent to those skilled in the art after considering the specification and the accompanying drawings. Therefore, any and all such changes, modifications, variations and other uses and applications which do not depart from the spirit and scope of the invention are deemed to be covered by the invention.

I claim:

1. A gate operator for pivotally moving, lifting and lowering a gate around a horizontal axis comprising:

horizontal pivot means for supporting proximate end of said gate for rotation of said gate through a 90° arc back and forth between horizontally closed and vertically open positions;

motor means for applying opening or closing force to said gate;

linkage means connecting said gate and said motor means for transmitting said force with relatively slower speed at the beginning and end of said rotation and with relatively greater speed therebetween;

spring means connected to said linkage means counterbalancing said gate in all positions along said arc, rendering said gate weightless; and snubber means connected to said linkage means for metered control of the speed of said gate's movement.

2. The gate operator of claim 1 wherein said linkage means includes a raceway and cam means.

3. The gate operator of claim 1 wherein said snubber means includes a hydraulic cylinder with a check valve.

4. The gate operator of claim 2 wherein said linkage means includes a slipping-clutch wheel means driven by said motor means for a slipping connection between the motor means and the raceway and cam means; and further comprising means for adjusting the force of the slipping connection.

5. The gate operator of claim 4, further comprising handle means including spaced lugs; said clutch wheel means having holes in radially spaced relationship for engaging with said lugs for manual actuation of the clutch wheel means for said gate lifting or lowering; and cover means including an access opening for operative engagement of a handle means with the clutch wheel means.

6. The gate operator of claim 4, and adjusting cam means for adjusting the tension of said spring means.

7. A gate operator as in claim 1 wherein said linkage means has a position for locking the gate in closed position and further comprising a cradle means for receiving and supporting the distal end of the gate in said gate's closed positions.

8. The gate operator of claim 7, said linkage means including wheel and crank means and raceway means for controllably moving the gate upwardly and downwardly about said horizontal pivotal axis with only manual force, regardless of the mass of the gate.

* * * * *